US010947962B1

(12) United States Patent
Olson et al.

(10) Patent No.: US 10,947,962 B1
(45) Date of Patent: Mar. 16, 2021

(54) LOW DISTURBANCE CRYOCOOLER COMPRESSOR

(71) Applicant: LOCKHEED MARTIN CORPORATION, Bethesda, MD (US)

(72) Inventors: Jeffrey R. Olson, San Mateo, CA (US); Alyssa Ruiz, San Francisco, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 208 days.

(21) Appl. No.: 16/153,608

(22) Filed: Oct. 5, 2018

(51) Int. Cl.

| | |
|---|---|
| ***F04B 1/047*** | (2020.01) |
| ***F04B 39/12*** | (2006.01) |
| ***F04B 1/0421*** | (2020.01) |
| ***F04B 1/04*** | (2020.01) |

(Continued)

(52) U.S. Cl.

CPC ..... *F04B 1/047* (2013.01); *F04B 1/04* (2013.01); *F04B 1/0404* (2013.01); *F04B 1/0421* (2013.01); *F04B 39/121* (2013.01); *F04B 39/122* (2013.01); *F04B 39/125* (2013.01); *F04B 39/127* (2013.01); *F04B 2015/082* (2013.01); *F04B 2015/0824* (2013.01)

(58) Field of Classification Search

CPC ..... F04B 1/04; F04B 1/0404; F04B 1/0421; F04B 1/047; F04B 2015/082; F04B 2015/0824; F04B 19/22; F04B 39/121; F04B 39/122; F04B 39/125; F04B 39/127

See application file for complete search history.

(56) References Cited

U.S. PATENT DOCUMENTS

| | | | | |
|---|---|---|---|---|
| 2,003,004 A * | 5/1935 | McQuaid | ..... | F04B 1/047 60/543 |
| 3,587,227 A * | 6/1971 | Weingarten | ..... | F03G 7/005 60/326 |
| 4,389,849 A | 6/1983 | Gasser et al. | | |

(Continued)

FOREIGN PATENT DOCUMENTS

| | | | | |
|---|---|---|---|---|
| CN | 107144803 A | 8/2017 | | |
| DE | 102016106232 B3 * | 8/2017 | ..... | F04B 53/162 |

(Continued)

OTHER PUBLICATIONS

Collins et al., "Multi-axis vibration cancellation for Stirling cryocoolers," Proceedings of the SPIE, Jun. 1994, Abstract only, retrieved from https://www.researchgate.net/publication/253344701_Multi-axis_vibration_cancellation_for_Stirling_cryocoolers.

(Continued)

*Primary Examiner* — Christopher S Bobish

(74) *Attorney, Agent, or Firm* — Morgan, Lewis & Bockius LLP

(57) ABSTRACT

A compressor assembly for use with a Pulse Tube cryocooler is disclosed. The compressor assembly includes a central hub having a plurality of faces, and at least four compressor modules mounted on the central hub. Each of the compressor modules is mounted on a face of the plurality of faces. Each compressor module comprises a piston mounted in the central hub and configured to reciprocate along an axis of travel within the central hub. The pistons are mounted head-to-head with each other and collective reciprocation of the pistons along the respective axes minimizes vibration forces of the compressor assembly in X, Y, and Z translational axes of motion.

16 Claims, 6 Drawing Sheets

(51) Int. Cl.
*F04B 1/0404* (2020.01)
*F04B 15/08* (2006.01)

(56) References Cited

U.S. PATENT DOCUMENTS

| | | | | |
|---|---|---|---|---|
| 4,500,265 | A | 2/1985 | Evans et al. | |
| 5,052,529 | A | 10/1991 | Sutcliffe et al. | |
| 5,392,607 | A | 2/1995 | Wu | |
| 5,412,951 | A | 5/1995 | Wu | |
| 5,734,246 | A | 3/1998 | Falangas | |
| 5,836,165 | A | 11/1998 | Champion et al. | |
| 5,975,864 | A * | 11/1999 | De Santis | F04B 1/0413 417/273 |
| 7,779,640 | B2 | 8/2010 | Price et al. | |
| 8,490,414 | B2 | 7/2013 | Hon et al. | |
| 8,910,824 | B2 | 12/2014 | Gore et al. | |
| 9,551,513 | B2 | 1/2017 | Yates et al. | |
| 9,776,739 | B2 | 10/2017 | Dmitriev et al. | |
| 10,677,058 | B2 * | 6/2020 | Dole | F01B 1/062 |
| 2014/0013776 | A1 * | 1/2014 | Champagne | F25B 9/02 62/6 |
| 2016/0050490 | A1 | 2/2016 | Bruckman et al. | |
| 2016/0123311 | A1 * | 5/2016 | Dole | F01B 1/0624 91/418 |
| 2017/0306936 | A1 * | 10/2017 | Dole | F04B 49/22 |

FOREIGN PATENT DOCUMENTS

| | | | | |
|---|---|---|---|---|
| FR | 695017 | A * | 12/1930 | F04B 1/047 |
| JP | 2004239206 | A | 8/2004 | |
| KR | 101092391 | B1 | 9/2011 | |
| WO | WO-2019197047 | A1 * | 10/2019 | F04B 43/026 |

OTHER PUBLICATIONS

Dimitriev et al., "An ultra-low vibration cryocooling kit based on a miniature Rotary Compressor," Proceedings of the 29th Annual Conference in Small Satellites, Aug. 2015, 5 pages.

* cited by examiner

LOW DISTURBANCE CRYOCOOLER COMPRESSOR

STATEMENT REGARDING FEDERALLY SPONSORED RESEARCH OR DEVELOPMENT

Not Applicable.

TECHNICAL FIELD

The present description relates in general to systems and methods for reducing vibration in cryocoolers, and more particularly to, for example, without limitation, systems and methods for active vibration cancellation in compressor modules of space cryocoolers.

BACKGROUND

The description provided in the background section should not be assumed to be prior art merely because it is mentioned in or associated with the background section. The background section may include information that describes one or more aspects of the subject technology.

Cryocoolers are generally used to cool devices, e.g., infrared detectors and focal planes, solid-state gamma-ray detectors, and superconducting devices, to cryogenic temperatures. Typical cryogenic temperatures could range, for example, from the boiling point of liquid Nitrogen at 77 K (−321° F.), down to the boiling point of liquid Helium at 4 K (−453° F.). Conventional cryocoolers include a motor used to drive a piston or displacer. Such motion can result in vibration of the cryocooler that can, in turn, disrupt operation of the cooled device. For example, when the cooled device is an optical detector system, such as a system that includes optics and/or a focal plane array, the performance degradation due to vibration attributable to the cryocooler module can reach undesirable levels.

Some smaller sensitive telescopes for space applications require cryocoolers having a configuration capable of experiencing only negligible vibration forces, in order to avoid image blurring. For such telescopes, the only acceptable cryocooler option currently is the Turbo-Brayton (Brayton) cryocooler. However, Brayton cryocoolers tend to be very large, and heavy, thereby making them unsuitable for satellites which require a more compact cryocooler.

Pulse tube or Stirling cryocoolers can be made much smaller, cheaper, and with greater versatility than Brayton coolers. However, Stirling and Pulse Tube cryocoolers often experience vibration levels higher than those suitable for space applications such as the smaller sensitive telescopes described above.

The description provided in the background section should not be assumed to be prior art merely because it is mentioned in or associated with the background section. The background section may include information that describes one or more aspects of the subject technology.

SUMMARY

In one or more implementations, a compressor assembly for a cryocooler is disclosed. The compressor assembly includes a central hub having a plurality of faces, and at least four compressor modules mounted on the central hub. Each of the compressor modules is mounted on a face of the plurality of faces. Each compressor module includes a piston mounted in the central hub and configured to reciprocate along an axis of travel within the central hub. The pistons are mounted head-to-head with each other and collective reciprocation of the pistons along the respective axes minimizes vibration forces of the compressor assembly in X, Y, and Z translational axes of motion.

In one or more implementations, an active vibration cancellation compressor assembly for a cryocooler is provided. The active vibration cancellation compressor assembly includes a central hub having eight faces and four compressor modules. The eight faces are coupled to each other to form a body having an interior. The four compressor modules are each mounted on one of the eight faces of the central hub in a tetrahedral configuration. Each compressor module includes a piston mounted at least partially in the interior of the central hub and configured to reciprocate along an axis of travel within the interior of the central hub. The pistons are mounted in a tetrahedral head-to-head orientation with respect to each other, and collective reciprocation of the pistons along the respective axes of travel minimizes vibration forces of the compressor assembly in X, Y, and Z translational axes of motion.

In one or more implementations, a method of assembly of a cryocooler compressor is disclosed. The method includes forming a central hub having eight faces coupled to each other to form a closed shape octahedral body having an interior, and mounting four compressor modules on the central hub in a tetrahedral configuration. Each of the compressor modules are mounted on one of the eight faces. The four faces on which the compressor modules are mounted each include a piston bore. Each compressor module includes a piston mounted at least partially in the interior of the central hub and configured to reciprocate along an axis of travel within the piston bore. Mounting the four compressor modules on the central hub further includes mounting the pistons head-to-head with each other such that collective reciprocation of the pistons along the respective axes of travel minimizes vibration forces of the compressor assembly in X, Y, and Z translational axes of motion.

It is to be understood that both the foregoing general description and the following detailed description are exemplary and explanatory and are intended to provide further explanation of the subject technology as claimed. It is also to be understood that other aspects may be utilized, and changes may be made without departing from the scope of the subject technology.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The most sensitive optical instruments require vibrational forces to be kept to a minimum, for example, on the order of 10 mN or less to retain the best image quality. Some sensitive cryogenic optical instruments often require exported vibration forces to be kept on the order of 1 mN or less. Mechanical cryocoolers typically have exported vibration levels of hundreds of mN in all directions, including the two lateral axes (non-controllable axes) which do not allow for active vibration cancellation. For example, conventional Pulse Tube cryocoolers have exported vibration levels of 100-1000 mN in the non-controllable axes of the compressor of the cryocooler.

Figure 1:
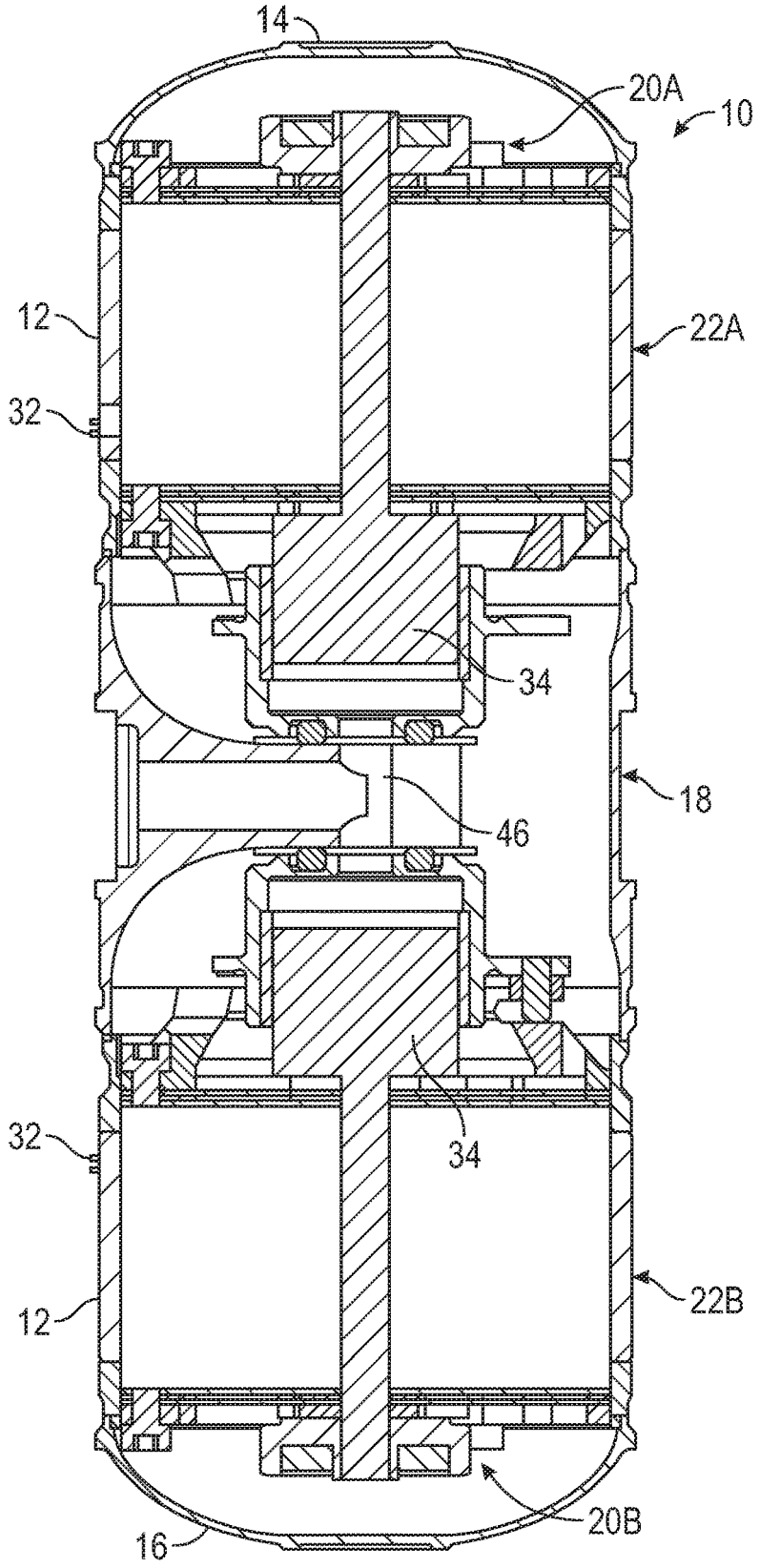
FIG. 1 (Prior Art)
FIG. 1 is a cross-sectional diagram illustrating a conventional compressor assembly used with a Pulse Tube cryocooler.

Although conventional Pulse Tube cryocoolers attempt to minimize vibration forces in their compressor modules, the conventional Pulse Tube cryocooler compressors (e.g., as illustrated in FIG. 1, and as shall be described in further detail below) only reduce vibration forces in one translation axis of motion which is the axis of piston motion. In order to limit the amount of vibration experienced, compressor modules of the traditional Pulse Tube or Stirling type cryocoolers, have generally employed dual opposed motors with an active vibration feedback and cancellation system, as illustrated in FIG. 1. In the depicted arrangement, the motors are placed in opposed orientations such that the moving piston driven by each motor is accelerated in opposite directions using, in an ideal implementation, identical forces. If the system is ideal, the net force experienced by the cryocooler compressor module would be zero. However, the aforementioned configuration performs active vibration cancellation only in the lateral axis of movement of the opposed pistons. Imperfect piston alignment, or other lateral piston motion due to mechanical or gas effects can result in forces in the lateral directions, perpendicular to the direction of piston motion. As a result, the traditional Stirling and Pulse Tube cryocooler compressor modules often experience vibration forces which result in unacceptable levels of vibration in the non-controllable axes.

Traditionally, Brayton cryocoolers, which have little to no measurable exported vibration, have been used for cooling the most sensitive instruments. However, typical Brayton coolers are large, heavy, and expensive as compared with typical Pulse Tube cryocoolers. Furthermore, it is difficult to scale Brayton coolers down in size and mass, and thus, Brayton cryocoolers are not suitable for small satellite applications.

The various embodiments disclosed herein are designed to provide a low vibration, relatively low cost, and efficient compressor assembly operable for use with Pulse Tube or Stirling type of cryocooler systems. Advantageously, the disclosed systems, apparatus and methods offer low-vibration, low-cost manufacturing of the compressor assembly without a significant increase in the size or weight in comparison to conventional compressor assemblies. For example, the compressor assemblies of the various embodiments described herein may reduce exported vibration forces from ~500 mN to less than 10 mN, well within limits required by sensitive missions. Due to the decreased vibration and reduced compressor losses of the compressor assemblies described herein, cryocooler efficiency may be increased by at least 20%. Further, due to the increased number of compressor modules, the compressor assemblies of the various embodiments described herein may exhibit double the input power and cooling power capability as compared to traditional compressor assemblies used with Pulse Tube or Stirling type cryocoolers.

Further, the disclosed cryocooler compressor configuration is straightforward to implement, and can be applied to all sizes of compressors. The various embodiments as described herein further improve cryocooler efficiency. For example, higher overall motor efficiency is achieved using at least four motor modules as compared with conventional Pulse Tube cryocoolers which utilize one or two motor modules. Moreover, various embodiments as described herein advantageously may achieve twice the cooling power and input power capability as compared with the conventional Pulse Tube cryocooler compressor configuration.

Referring now to FIG. 1, a conventional compressor assembly configured for use with a Pulse Tube cryocooler is shown. As illustrated, a compressor 10 is provided and has a generally cylindrical exterior surface 12 and two dome shaped end caps 14, 16. As best shown in FIG. 1, the compressor 10 includes a central hub 18 operable for receiving and maintaining at least one compressor pump 20A, 20B, at least one motor module 22A, 22B, for generating power to the compressor pumps 20A, 20B, and the two dome shaped end caps 14, 16. In the illustrations shown, the at least one motor module has a motor power lead 32 connected to its external surface 12. As depicted, the compressor 10 includes the two compressor pumps 20A and 20B located adjacent to each other such that they operate in an in-line manner. Each compressor pump 20A, 20B is seated within the compressor hub 18 and encased by respective motor modules 22A and 22B. Each of the compressor pumps 20A and 20B include a piston 34. The motor modules 22A and 22B may each support a moving magnet or moving coil assembly 44 that is used to move the piston 34 in an oscillating manner.

During operation, vibration is generated in the compressor 10. The vibration of the compressor 10 has a negative effect in the sense that the vibration harmonics generally excite spacecraft resonances and prevent on-board sensors from achieving their operational goals with respect to resolution and pointing accuracy. In an effort to overcome the effects of vibration, prior art compressors, such as the compressor 10 illustrated in FIG. 1 incorporates vibration suppression by positioning the two pistons 34 head-to-head, and controlling motion of the pistons to be in directions opposite to each other. The opposed motion of the pistons 34 relative to each other allows for cancellation of vibration in the axis of motion of the pistons 34. However, since cryocoolers typically experience vibration in all three translational axes of motion, i.e., the X, Y, and Z translational axes of motion, prior art compressors such as the compressor 10 of FIG. 1 fail to address vibration forces experienced in the remaining two axes in which the pistons 34 do not reciprocate.

It would therefore be advantageous to provide a cryocooler having a compressor module capable of active vibration cancellation in all three translational axes of motion. Various embodiments of the present disclosure are directed to providing a compressor assembly having such a configuration.

Figure 2A:
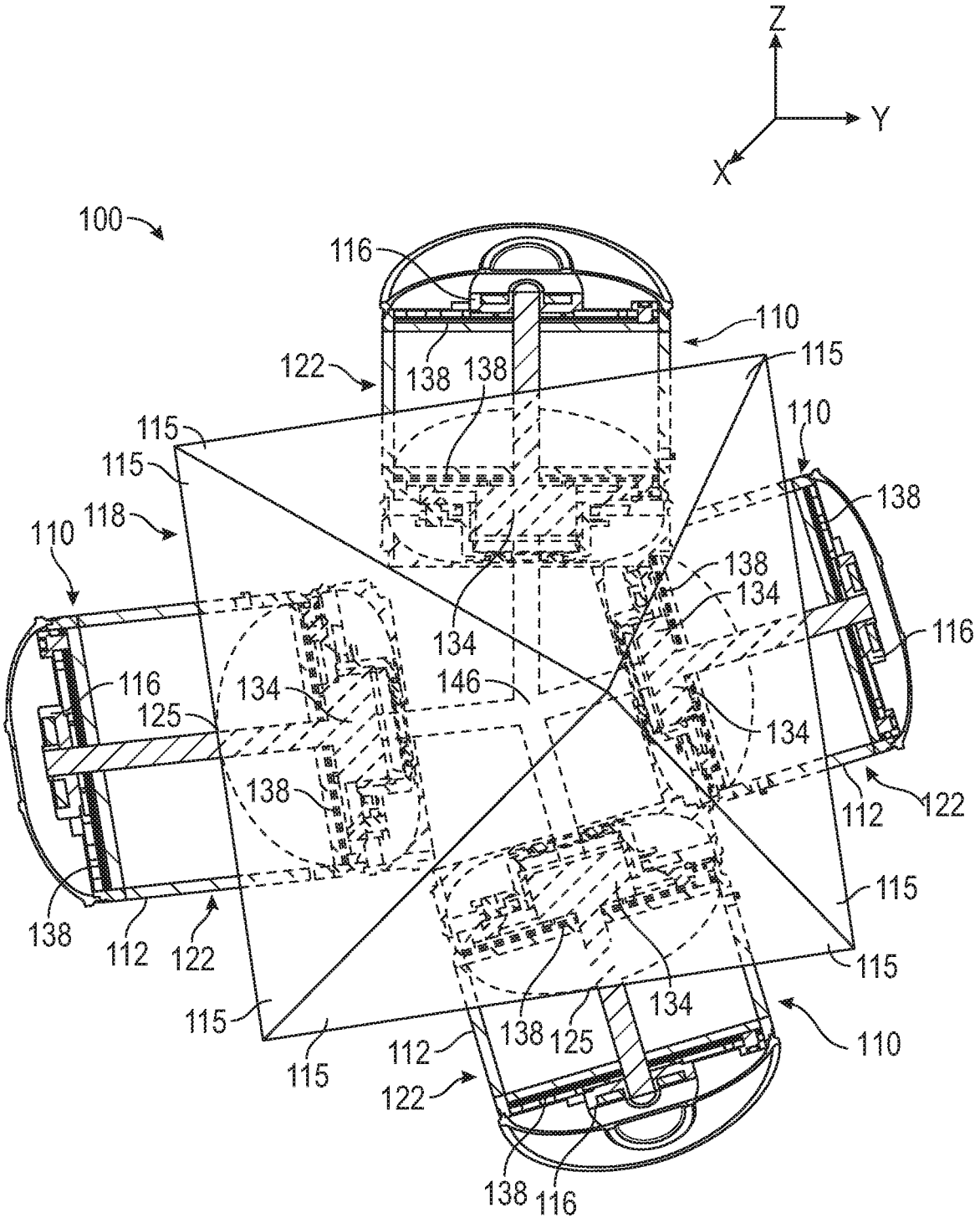
FIG. 2A is a cross-sectional view illustrating a compressor assembly for use with a Pulse Tube cryocooler, according to some embodiments of the present disclosure.
Figure 2B:
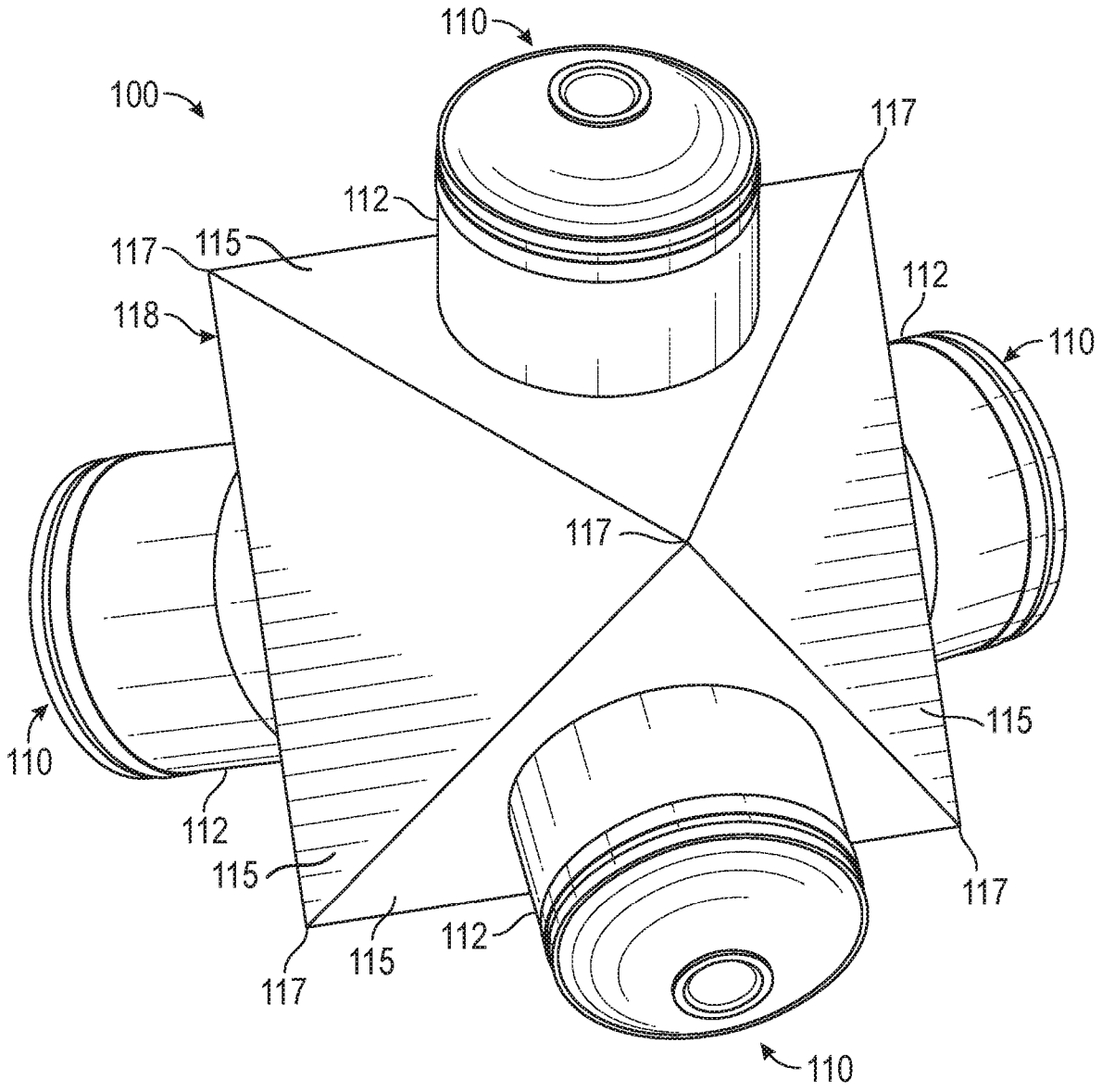
FIG. 2B is a perspective view illustrating the compressor assembly of FIG. 2A, according to some embodiments of the present disclosure.

FIG. 2A is a cross-sectional view illustrating a compressor assembly 100 for use with a Pulse Tube cryocooler, according to some embodiments of the present disclosure. FIG. 2B is a perspective view illustrating the compressor assembly 100 of FIG. 2A, according to some embodiments of the present disclosure. Referring to FIG. 2A, a cross-sectional diagram of a compressor assembly 100 configured for use with a Pulse Tube cryocooler is shown. As shown, each compressor module 110 of the compressor assembly 100 is provided and has a generally cylindrical body 112 and two dome shaped end caps. As best shown in FIGS. 2A and 2B, the compressor assembly 100 includes a central hub 118 having a plurality of faces 115. The compressor assembly 100 may further include at least four compressor modules 110 mounted on the faces 115 of the central hub 118. As depicted, the central hub 118 may be operable for receiving and maintaining, for each compressor module 110, at least one piston 134 for pumping a compressed fluid to a common compression space 146 of the central hub 118, and at least one motor module 122 for generating power to the piston 134. In some embodiments, the compression space 146 may be fluidly connected to a coldhead (not shown) of the Pulse Tube cryocooler through a transfer line (not shown) which is configured to exit the compression space 146 through one of the four faces 115 which do not have a compressor module 110 mounted thereon.

In the depicted embodiments, the central hub 118 is operable for receiving and maintaining four pistons 134 and four corresponding motor modules 122 to drive the pistons 134. However, the various embodiments of the present disclosure are not limited to the aforementioned configuration. Any suitable number of compressor modules may be mounted to the central hub 118 depending on a shape or configuration thereof in a manner conducive for active vibration cancellation in all three translational axes of motion of the compressor assembly 100.

Each piston 134 may be seated within the central hub 118 and encased by respective motor modules 122. Each of the pistons may be 134 mounted with a gas connection interior of the central hub 118 and operable to reciprocate along an axis of travel within the central hub 118. Each piston 134 may be equipped with forward and aft flexure spiral flexure bearings 138. At least one of the flexure bearings 138 may be equipped with a clamp 116 for securely mounting the piston 134. The flexure bearings 138 may support a moving magnet or a moving coil that is part of the motor module 122 used to move the piston 134 in an oscillating manner.

In some embodiments, the motor module 122 may include the moving magnet, and a stationary core. The magnet may be configured to reciprocate, thereby causing corresponding reciprocation of each of the pistons 134. The coils and core may form a coil-core stator assembly which remains stationary and modulates flux across a gap where the magnet resides. The coils may be wound and connected so that magnetic flux generated by the current in each coil adds constructively in the gap where the magnet resides. This flux may interact with flux generated by the magnet, thereby causing the magnet to react with a force in one of two directions along an axis of motion, depending on coil flux polarity. For example, the core/coil combination produces south and north poles as a function of current applied to the magnet. When current is applied to the magnet, the appropriate poles of the magnet are either attracted or repelled to produce force which reciprocates the corresponding piston 134 in one of two directions along the axis of motion. In other embodiments, the motor module 122 may include the moving coil instead of the moving magnet. In addition, in the illustrations shown the compressor assembly 100 may include a common compression space 146 interposed between the compressors pumps 120 and through a central wall of the central hub 118.

Figure 2C:
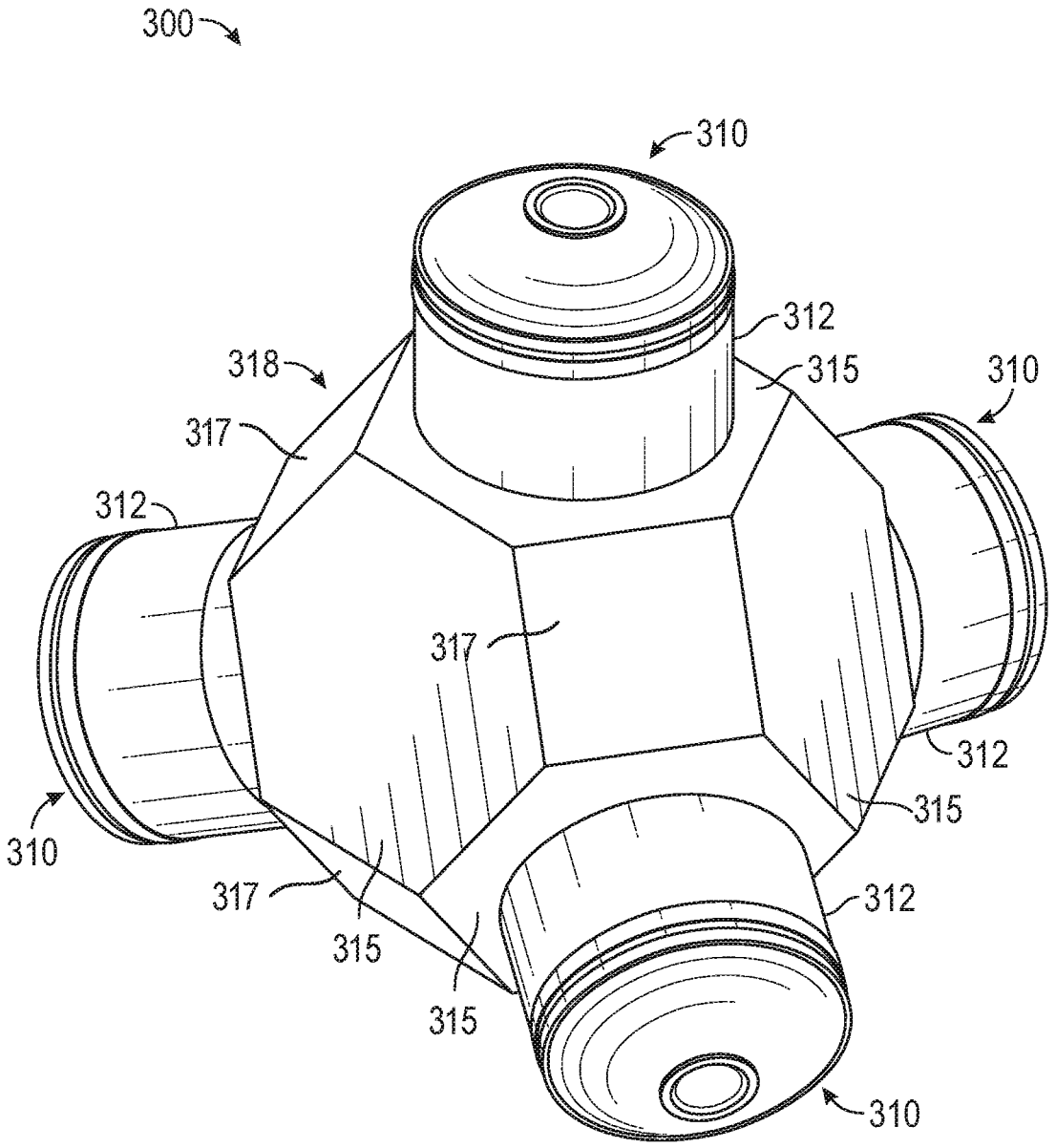
FIG. 2C is a perspective view illustrating a compressor assembly for use with a Pulse Tube cryocooler, according to some embodiments of the present disclosure.

Referring specifically to FIG. 2A, a cross-sectional diagram of the compressor assembly 100 is shown. In some embodiments, as illustrated, the central hub 118 may be an octahedral shaped hub having eight faces 115. In these embodiments, the four compressor modules 110 may be mounted in a tetrahedral configuration on four of the eight faces 115. For example, each of the compressor modules 110 may be welded or otherwise attached to one of the eight faces 115. In some embodiments, each of the eight faces may be shaped as a triangular surface. In particular, each of the faces 115 may be formed in the shape of an equilateral triangle. However, the various embodiments of the present disclosure are not limited to the aforementioned configuration. The shape and size of the faces 115 of the central hub 118 may vary based on design constraints in any manner conducive for active vibration cancellation in all three translational axes of motion of the compressor assembly 100. For example, FIG. 2C is a perspective view illustrating a compressor assembly 300 for use with a Pulse Tube cryocooler, according to some embodiments of the present disclosure. The embodiments of FIGS. 2B and 2C are similar to the configurations of the compressor modules 110 and 310, but differ in the structure of the central hubs 118 and 318. As depicted in FIG. 2C, the central hub 318 may be an octahedral shaped hub having eight faces 315. In these embodiments, the four compressor modules 110 may be mounted in a tetrahedral configuration on four of the eight faces 315. For example, each of the compressor modules 110 may be welded or otherwise attached to one of the eight faces 115. In the embodiments illustrated in FIG. 2C, each of the eight faces may be shaped as a hexagonal surface. The hexagonal faces may be formed for example, by truncating each of the vertices 117 of the octahedral hub 118 into a flat or planar surface. In the depicted embodiments, each of the vertices 117 of the central hub 118 are truncated into a flat square surface. The central hub 318 thus may have eight hexagonal faces 315 (four of which each have one of the compressor modules 310 mounted thereon) and eight square faces 317. However, the various embodiments of the present disclosure are not limited to the aforementioned configuration. The vertices 117 of the central hub 118 may be truncated into any suitable flat or planar shape which produces a central hub capable of mounting four compressor modules in a tetrahedral configuration. The aforementioned configuration is advantageous in that the central hub 318 is formed of less material, thereby making the central hub 318 lighter in weight, and more compact in size as compared to the embodiments of FIG. 2B.

The aforementioned tetrahedral configuration yields an extremely stable structure which is configured to minimize vibrations better than conventional compressor assemblies such as that illustrated in FIG. 1. The ability of the described tetrahedral configuration to minimize vibration in all three translational axes lies in the manner that the tetrahedral structure is kinematically balanced. When vibrations travel through a tetrahedral structure, they are cancelled out or minimized due to the interference between the vibrating waves as they travel through the tetrahedral structure. The compressor assembly 100 thus may be modelled as four cylindrical bodies 112 positioned at vertices of a tetrahedron, with the central hub 118 forming the structural links between the four cylindrical bodies 112. The tetrahedral configuration of the compressor modules 110 relative to each other similarly allows for a tetrahedral head-to-head mounting configuration of the pistons 134 of the compressor modules 110 relative to each other. As the compressor assembly 100 experiences vibration during normal operation, the pistons 134 may be controlled such that the collective reciprocation of the pistons 134 along the respective axes minimizes or ideally cancels out vibration forces in all three translational axes of motion (i.e., the X, Y, and Z translation axes of motion) of the compressor assembly 100. Because the four pistons in compressor assembly 100 have active motion in all three directions (X, Y, and Z), active vibration cancellation can be employed to reduce vibrations in all three directions. To this effect, the compressor assembly 100 may further include a controller configured to execute various predetermined instructions or algorithms such that motion of the pistons 134 is controlled to effectively minimize or ideally cancel out oscillations or vibrations that would normally be transmitted in all three translational axes of motion of the compressor assembly 100. The aforementioned configuration thus advantageously prevents displacement of the compressor assembly 100 from its equilibrium position due to vibration forces experienced during operation. Vibration cancellation in the embodiments of FIGS. 2A-2C is achieved by the fact that the compressor modules 100 and 300 each have components which are mounted and move in all three translational axes of motion, so that vibration forces in all three translational axes of motion can be actively canceled. The resulting minimization or cancellation of vibration in the compressor assembly 100 thereby may advantageously prevent vibration force interference with on-board sensors of the spacecraft from achieving their operational goals with respect to resolution and pointing accuracy.

In accordance with various embodiments of the present disclosure, a method of assembly of the compressor 100 for use with a Pulse Tube cryocooler is provided. The method may include forming a central hub 118 including eight faces 115 coupled to each other to form a closed shape octahedral body having an interior. The method may further include mounting four compressor modules 110 on the central hub 118 in a tetrahedral configuration. For example, each of the compressor modules 110 may be mounted on one of the eight faces 115. The four faces 115 on which the compressor modules 110 are mounted may each comprise a piston bore 125, and each compressor module may include a piston 134 mounted at least partially in the interior of the central hub 118. Each piston 134 may thus be configured to reciprocate along an axis of travel within the piston bore 134.

Mounting the four compressor modules 110 on the central hub 118 may further include mounting the pistons 134 head-to-head with each other such that collective reciprocation of the pistons 134 along the respective axes of travel minimizes vibration forces of the compressor assembly 100 in the X, Y, and Z translational axes of motion. The mounting may further include encasing each piston 134 with a motor module 122 configured to drive reciprocation of the piston 134 within the central hub 118. As described above each compressor module 110 may include flexure bearings coupled to the piston 134, and the method may further include mounting a moving magnet or a moving coil of the motor module 112 on at least one of the flexure bearings 138 of each motor module 122 to drive the reciprocation of the respective piston 134. In some embodiments, the method of assembly may further include electrically coupling a controller to each motor module 122 to control reciprocation of the pistons 134 along the respective axes of travel and minimize vibration forces of the compressor assembly in the X, Y, and Z translational axes of motion.

Figure 3A:
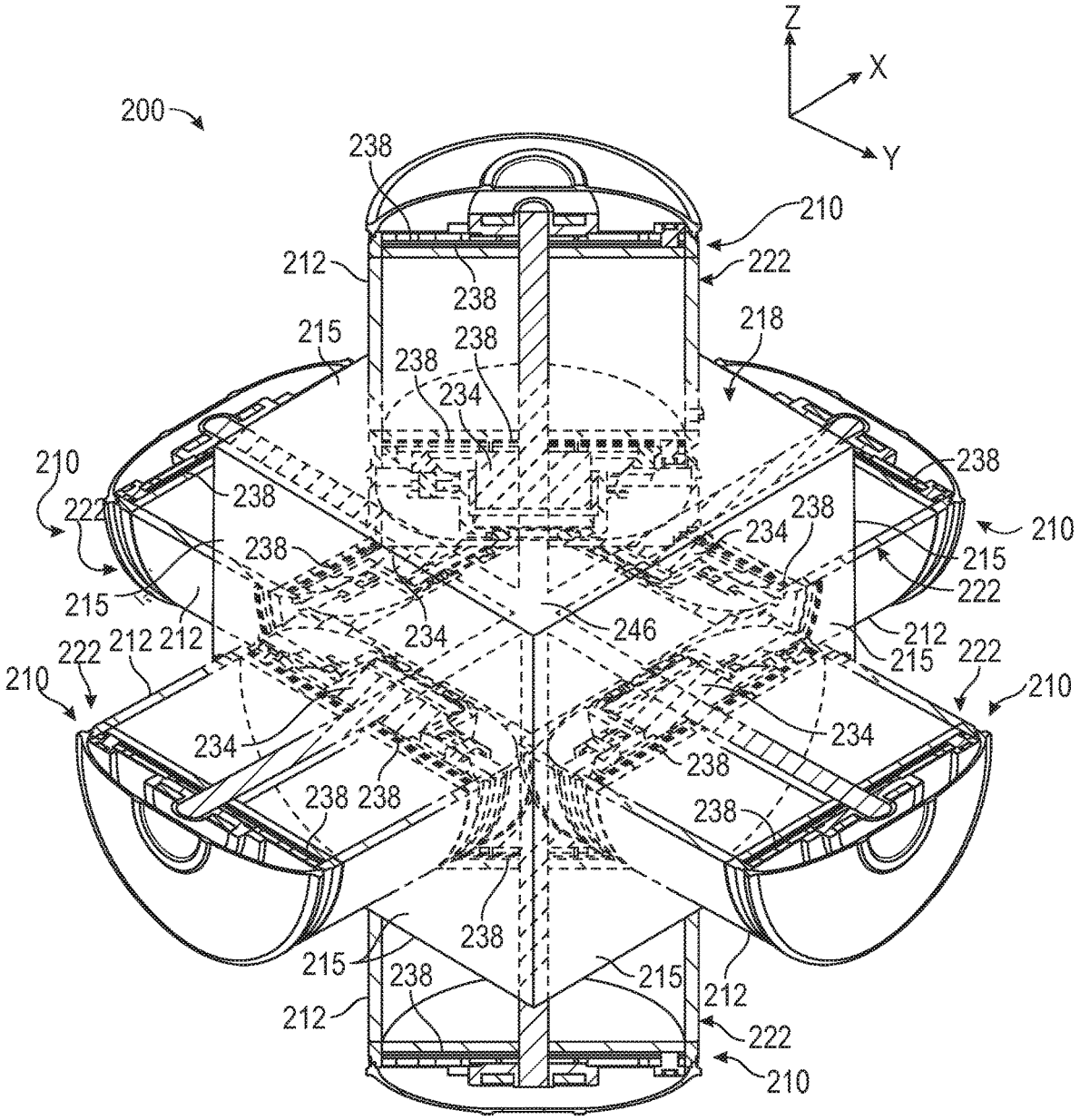
FIG. 3A is a cross-sectional view illustrating a compressor assembly for use with a Pulse Tube cryocooler, according to some embodiments of the present disclosure.
Figure 3B:
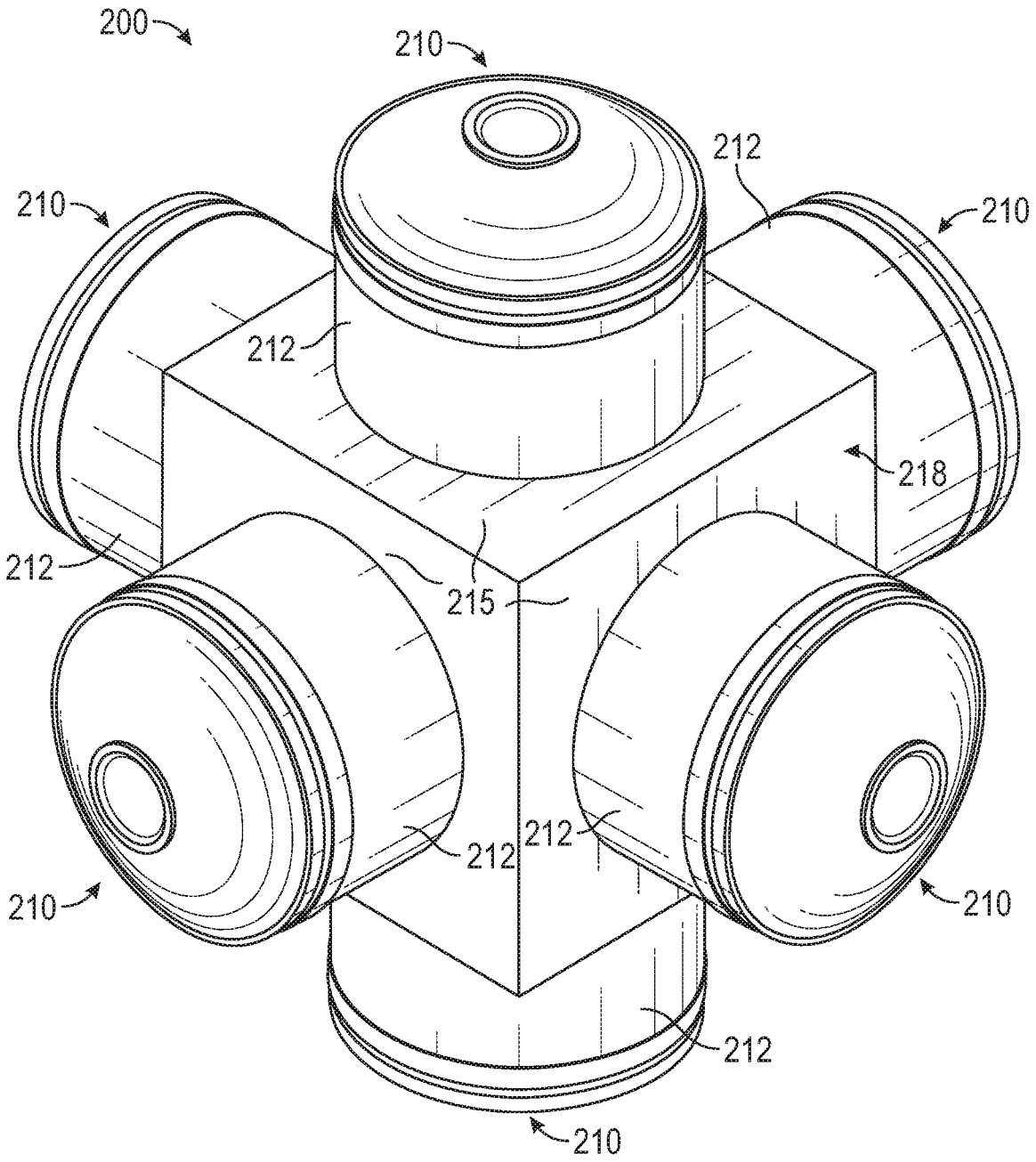
FIG. 3B is a perspective view illustrating the compressor assembly of FIG. 3A, according to some embodiments of the present disclosure.

FIG. 3A is a cross-sectional view illustrating a compressor assembly for use with a Pulse Tube cryocooler, according to some embodiments of the present disclosure. FIG. 3B is a perspective view illustrating the compressor assembly of FIG. 3A, according to some embodiments of the present disclosure. Referring to FIG. 3A, a cross-sectional diagram of a compressor assembly 200 configured for use with a Pulse Tube cryocooler is shown. As shown, each compressor module 210 of the compressor assembly 200 is provided and may have a generally cylindrical body 212 and two dome shaped end caps. As best shown in FIGS. 3A and 3B, the compressor assembly 200 includes a central hub 218 having a plurality of faces 215. The compressor assembly 200 may further include at least six compressor modules 210 mounted on the faces 215 of the central hub 218. For example, each of the compressor modules 210 may be welded or otherwise attached to one of the eight faces 215. As depicted, the central hub 218 may be operable for receiving and maintaining, for each compressor module 210, at least one piston 234 for pumping a compressed fluid to a common compression space 246 of the central hub 218, and at least one motor module 222 for generating power to the piston 234. In the depicted embodiments, the central hub 218 is operable for receiving and maintaining six pistons 234 and six corresponding motor modules 222 to drive the pistons 234. However, the various embodiments of the present disclosure are not limited to the aforementioned configuration. Any suitable number of compressor modules may be mounted to the central hub 218 depending on a shape or configuration thereof in a manner conducive for active vibration cancellation in all three translational axes of motion of the compressor assembly 200.

Each piston 234 may be seated within the central hub 218 and encased by respective motor modules 222. Each of the pistons 234 may be mounted with a gas connection to the interior the central hub 218 and operable to reciprocate along an axis of travel within the central hub 218. Each piston 234 may be equipped with forward and aft flexure spiral flexure bearings 238. Similar to the embodiments of FIGS. 2A and 2B, the flexure bearings 238 may support a moving magnet or a moving coil that is part of the motor module 222 used to move the piston 234 in an oscillating manner. The moving magnet or moving coil may be similar in structure to, and function similarly to the moving magnet or moving coil described with respect to FIG. 2A. Thus a detailed description thereof shall be omitted. In addition, in the depicted embodiments the compressor assembly 200 may include a common compression space 246 interposed between the pistons 234 and through a central wall of cylinder sealing surface of the central hub 218.

Referring specifically to FIG. 3A, a cross-sectional diagram of the compressor assembly 200 is shown. In some embodiments, as illustrated, the central hub 218 may be a cubical shaped hub having six faces 215. In these embodiments, the six compressor modules 210 may be mounted on the six faces 215. As such, the six compressor modules 210 may be arranged as three pairs of compressor modules 215, each pair of compressor modules 210 being coaxially mounted on opposing faces of the central hub 218. For example, each pair of compressor modules 210 may be coaxially mounted along an axis of the central hub 218 corresponding to one of the three (X, Y, and Z) translational axes of motion. Accordingly, a first pair of the compressor modules 210 may be coaxially mounted on the central hub 218, along the X translational axis of motion. As such, the pistons 234 of the first pair of compressor modules may be mounted head-to-head and controlled to reciprocate in opposed directions so as to minimize or ideally cancel out vibration forces in the X translational axis of motion. Simultaneously, the pistons 234 of the second pair of compressor modules may be mounted head-to-head and controlled to reciprocate in opposed directions so as to minimize or ideally cancel out vibration forces in the Y translational axis of motion. Similarly, and simultaneously with the pistons of the first and second pairs of compressor modules 210, the pistons 234 of the third pair of compressor modules 210 may be mounted head-to-head and controlled to reciprocate in opposed directions so as to minimize or ideally cancel out vibration forces in the Z translational axis of motion.

As the compressor assembly 200 experiences vibration during normal operation, the pistons 234 may be controlled as described above, such that the collective reciprocation of the pistons along the respective axes of motion minimizes or ideally cancels out vibration forces of the compressor assembly all three translational axes of motion of the compressor assembly 200. To this effect, the compressor assembly 200 may further include a controller configured to execute various predetermined instructions or algorithms such that motion of the pistons 234 is controlled to be out of phase with each other so as to minimize or ideally cancel out oscillations or vibrations that would normally be transmitted in all three translational axes of motion of the compressor assembly 200. The aforementioned configuration thus prevents displacement of the compressor assembly 200 from its equilibrium position due to vibration forces experienced during operation. Similar to the embodiments described with respect to FIGS. 2A and 2B, the resulting minimization or cancellation of vibration in the compressor assembly 200 thereby may advantageously prevents vibration force interference with on-board sensors of the spacecraft from achieving their operational goals with respect to resolution and pointing accuracy.

In some embodiments, each of the six faces may be shaped as a parallelogram-shaped surface. In particular, each of the faces 215 may be formed in the shape of a rectangle or a square. However, the various embodiments of the present disclosure are not limited to the aforementioned configuration. The shape and size of the faces 215 of the central hub 218 may vary based on design constraints in any manner conducive for active vibration cancellation in all three translational axes of motion of the compressor assembly 200.

In accordance with various embodiments of the present disclosure, a method of assembly of the compressor 200 for use with a Pulse Tube cryocooler is provided. The method may include forming a central hub 218 including six faces 215 coupled to each other to form a closed shape cubical body having an interior. The method may further include mounting six compressor modules 210 on the central hub 218. For example, each of the compressor modules 210 may be mounted on one of the six faces 215. The six faces 215 on which the compressor modules 210 are mounted may each comprise a piston bore, and each compressor module may include a piston 234 mounted at least partially in the interior of the central hub 218. Each piston 234 may thus be configured to reciprocate along an axis of travel within the piston bore.

Mounting the four compressor modules 210 on the central hub 218 may further include mounting the pistons 234 head-to-head with each other such that collective reciprocation of the pistons 234 along the respective axes of travel minimizes vibration forces of the compressor assembly 200 in the X, Y, and Z translational axes of motion. The mounting may further include encasing each piston 234 with a motor module 222 configured to drive reciprocation of the piston 234 within the central hub 218. As described above each compressor module 210 may include flexure bearings coupled to the piston 234, and the method may further include mounting a moving magnet or a moving coil of the motor module 222 on at least one of the flexure bearings 238 of each motor module 222 to drive reciprocation of the respective piston 234. In some embodiments, the method of assembly may further include electrically coupling a controller to each motor module 122 to control reciprocation of the pistons 234 along the respective axes of travel and minimize vibration forces of the compressor assembly 200 in the X, Y, and Z translational axes of motion.

The various embodiments disclosed herein are thus directed to providing a low vibration, relatively low cost, and efficient compressor assembly operable for use with Pulse Tube or Stirling type of cryocooler systems. Advantageously, the disclosed systems, apparatus and methods offer low-vibration, low-cost manufacturing of the compressor assembly without a significant increase in the size or weight in comparison to conventional compressor assemblies. For example, the compressor assemblies of the various embodiments described herein may reduce exported vibration forces from ~500 mN to less than 10 mN, well within limits required by sensitive missions. Due to the decreased vibration and reduced compressor losses of the compressor assemblies described herein, cryocooler efficiency may be increased by at least 20%. Further, due to the increased number of compressor modules, the compressor assemblies of the various embodiments described herein may exhibit triple the input power and cooling power capability as compared to traditional compressor assemblies used with Pulse Tube or Stirling type cryocoolers.

Moreover, the disclosed cryocooler compressor configuration is straightforward to implement, and can be applied to all sizes of compressors. The various embodiments as described herein further improve cryocooler efficiency. For example, higher overall motor efficiency is achieved using at least four motor modules as compared with conventional Pulse Tube cryocoolers which utilize two or fewer motor modules. Furthermore, the various embodiments as described herein advantageously may achieve at least twice the cooling power and input power capability as compared with the conventional Pulse Tube cryocooler compressor configuration.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the disclosure. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A compressor assembly comprising: a central hub comprising a plurality of faces; and four compressor modules mounted on the central hub, each of the compressor modules being mounted on a face of the plurality of faces, wherein the four compressor modules are mounted in a tetrahedral configuration on four of the plurality of faces, wherein each compressor module comprises a piston mounted in the central hub and configured to reciprocate along an axis of travel within the central hub, and wherein the pistons are mounted head-to-head with each other and collective reciprocation of the pistons along the respective axes minimizes vibration forces of the compressor assembly in X, Y, and Z translational axes of motion.

2. The compressor assembly of claim 1, wherein the central hub comprises eight faces.

3. The compressor assembly of claim 2, wherein the central hub comprises an octahedral shaped hub and each of the eight faces comprises an equilateral triangle.

4. The compressor assembly of claim 1, wherein each compressor module further comprises a motor module encasing the piston, and configured to drive reciprocation of the piston within the central hub.

5. The compressor assembly of claim 1, wherein each compressor module further comprises flexure bearings coupled to the piston, and the motor module comprises a moving magnet or a moving coil configured to drive the reciprocation of the piston, wherein the flexure bearings support the moving magnet or the moving coil.

6. The compressor assembly of claim 1, further comprising a controller configured to control reciprocation of the pistons along the respective axes to minimize vibration forces experienced by the compressor assembly in the X, Y, and Z translational axes of motion.

7. An active vibration cancellation compressor assembly, comprising:

a central hub having eight faces, the eight faces being coupled to each other to form a body having an interior; and four compressor modules, each mounted on one of the eight faces, the four compressor modules being mounted on the central hub in a tetrahedral configuration, wherein:

each compressor module comprises a piston mounted at least partially in the interior of the central hub and configured to reciprocate along an axis of travel within the interior of the central hub; and the pistons are mounted in a tetrahedral head-to-head orientation with respect to each other, and collective reciprocation of the pistons along the respective axes of travel minimizes vibration forces of the compressor assembly in X, Y, and Z translational axes of motion.

8. The active vibration cancellation compressor assembly of claim 7, wherein each of the eight faces comprises an equilateral triangle or a hexagon shape.

9. The active vibration cancellation compressor assembly of claim 7, wherein each compressor module further comprises a motor module encasing the piston, and configured to drive reciprocation of the piston within the central hub.

10. The active vibration cancellation compressor assembly of claim 9, wherein each compressor module further comprises flexure bearings coupled to the piston, and the motor module comprises a moving magnet or a moving coil configured to drive the reciprocation of the piston, and wherein the flexure bearings support the moving magnet or the moving coil.

11. The active vibration cancellation compressor assembly of claim 7, further comprising a controller configured to control reciprocation of the pistons along the respective axes of travel to minimize vibration forces experienced by the compressor assembly in the X, Y, and Z translational axes of motion.

12. A method of assembly of a compressor, comprising:

forming a central hub comprising eight faces coupled to each other to form a closed shape body having an interior;

mounting four compressor modules on the central hub in a tetrahedral configuration, each of the compressor modules being mounted on one of the eight faces, wherein:

the four faces on which the compressor modules are mounted each comprise a piston bore, and each compressor module comprises a piston mounted at least partially in the interior of the central hub and configured to reciprocate along an axis of travel within the piston bore; and the mounting four compressor modules on the central hub further comprises mounting the pistons head-to-head with each other such that collective reciprocation of the pistons along the respective axes of travel minimizes vibration forces of the compressor in X, Y, and Z translational axes of motion.

13. The method of claim 12, wherein the mounting four compressor modules on the central hub further comprises encasing the piston with a motor module, the motor module configured to drive reciprocation of the piston within the central hub.

14. The method of claim 13, wherein each compressor module further comprises flexure bearings coupled to the piston, the method further comprising mounting a moving magnet or a moving coil of the motor module on at least one of the flexure bearings of each compressor module, each moving magnet or moving coil configured to drive the reciprocation of the respective piston.

15. The method of claim 12, further comprising electrically coupling a controller to each motor module to control reciprocation of the pistons along the respective axes of travel to minimize vibration forces experienced by the compressor in the X, Y, and Z translational axes of motion.

16. The method of claim 12, wherein each of the eight faces comprises a triangular-shaped surface or a hexagonal-shaped face.

* * * * *